United States Patent [19]

Womack

[11] 4,183,105

[45] Jan. 15, 1980

[54] SELF-CLEANING TOILET

[76] Inventor: Leo K. Womack, P.O. Box 53133, New Orleans, La. 70153

[21] Appl. No.: 848,084

[22] Filed: Nov. 3, 1977

[51] Int. Cl.[2] ..... E03D 9/00; A47K 13/00; A47K 13/30; B08B 3/02

[52] U.S. Cl. ..... 4/1; 4/223; 4/233; 4/300; 4/420; 134/167 R

[58] Field of Search ..... 4/1, 7, 145, 222, 223, 4/224, 228, 229, 230, 233, 300, 309, 345, 420, 237, 239, 242, 302, 312, 405, 187 R; 134/166 R, 167 R, 168 R, 175, 177

[56] References Cited

U.S. PATENT DOCUMENTS

| | | | |
|---|---|---|---|
| 2,480,931 | 9/1949 | Jaeger | 134/177 X |
| 2,605,478 | 8/1952 | Lassiter | 4/233 |
| 3,166,767 | 1/1965 | Jewell et al. | 4/312 |
| 3,381,312 | 5/1968 | Whitla | 4/233 |
| 3,646,617 | 3/1972 | Heald | 4/1 |
| 3,919,726 | 11/1975 | Godwin et al. | 4/1 X |
| 3,988,788 | 11/1976 | Ave | 4/233 |
| 4,075,718 | 2/1978 | Hargraves | 4/300 |

FOREIGN PATENT DOCUMENTS

| | | | |
|---|---|---|---|
| 207221 | 8/1907 | Fed. Rep. of Germany | 4/1 |
| 1939512 | 2/1971 | Fed. Rep. of Germany | 4/233 |

*Primary Examiner*—Stuart S. Levy

[57] ABSTRACT

A self-cleaning toilet which embodies the combination of an open top toilet bowl and elevated reservoir tank mounted above said bowl, the reservoir tank including a water supply inlet for supplying water to said reservoir tank for discharge to said toilet bowl, and a separate compartment within which a biodegradable chemical or biological substance can be stored, removed therefrom and admixed with water, and the liquid supplied to the toilet bowl to clean, disinfect and deodorize said toilet bowl. Various features include a seat and lid pivotally attached to said open top toilet bowl, means for sealing the lid when it is lowered atop the bowl, internal conduits and nozzle outlets located within the top of said lid communicated with said water supply inlet, and an outlet from the compartment within the reservoir tank from which said biodegradable chemical or biological substances can be passed via the internal conduits of the lid to the nozzle outlets, admixed with water and liquid discharged via the nozzles of the lid, when the lid is closed, as a spray into the toilet bowl to clean, disinfect, and deodorize said bowl.

10 Claims, 4 Drawing Figures

SELF-CLEANING TOILET

An assessment of the health hazards of our environment involves considerable uncertainty. There is little doubt, however, that human waste carries infectious pathogens for a number of intestinal diseases, typhoid fever, hepatitis, brucellosis, encephalitis, poliomyelitis, psittacosis, and tuberculosis. There are also grave uncertainties about the die-off rates of pathogens as well as their infectiousness. However, in any event, there can be no doubt from a hygienic point of view of the need for keeping toilet facilities clean. Nor can there be any doubt of the necessity for cleanliness, albeit the presently required methods for scouring and cleaning toilets leave much to be desired.

Various self-cleaning devices have been introduced which have made former housekeeping duties less unpleasant. For example, the job formerly associated with cleaning dirty, greasy ovens has disappeared in many households and restaurants. Now, rather than manually scour ovens with soap cleansers, one need only increase the temperature of the oven to a certain set point and the grease and grime disappear in a cloud of smoke which is exhausted via a vent to the outside. The oven remains spotlessly clean with no need for manual scouring required. A dirty job has been eliminated in a very painless way.

There also exists an acute need for the elimination of the manual work required for scouring and cleaning toilets; and perhaps no housekeeping job is more unpleasant than the cleaning and scouring of public toilets.

It is, accordingly, the primary object of the present invention to supply this need.

A specific object of this invention is to provide a novel toilet, particularly one capable of safely and effectively handling biodegradable chemical or biological substances, or both, used therein to effect actions which clean, disinfect and deodorize, as well as aid in the decomposition of waste material ultimately disposed of as sewerage.

A further object is to provide a toilet of such character of sturdy construction, which can be economically constructed, easily operated, and maintained.

These and other objects are achieved in accordance with the present invention which embodies a self-cleaning toilet constituted of toilet bowl, provided with a seat and lid, an elevated reservoir tank which contains a compartment within which biodegradable chemicals or biological substances, or both, can be contained. The facility embodies means which include a cycle of operation wherein fresh water can be supplied to the reservoir tank for ordinary flushing, and a cycle of operation inclusive of means for supplying water to which portions of said biodegradable chemicals or biological substances, or both, are added for use in cleaning, disinfecting and deodorizing said toilet bowl.

In a preferred embodiment, an open top toilet bowl is provided with a seat pivotally connected to a side of the bowl so that it can be raised and lowered, and with a lid pivotally connected to the bowl which is provided with liquid supply inlets and nozzle outlets through which liquid can be supplied for actuation of the nozzles which, when the seat is raised and the lid lowered to close with the open top of the bowl, will deliver spray to the bowl interior. The elevated reservoir tank is provided with (a) a first mechanism which includes a valved water supply inlet and a second valved means, suitably a float actuated valve, for introducing and regulating the flow of water to the tank, and a hand actuatable float seated within an outlet from the tank (or inlet to the toilet bowl) for releasing and shutting off the flow of water from the tank to the toilet bowl, and (b) a second mechanism comprised of a multiple terminal conduit, one end of which is connected through the eductor to the reservoir which contains the source of biodegradable chemicals or biological substances, and the other to the liquid supply inlet to the lid whereby, when the valved water supply inlet to the reservoir tank is closed, the valve to said multiple terminal conduit is open and water can flow through the eductor to cause withdrawal of substance from the reservoir which contains the chemicals or biological substances, and admixing of same with the water, which is then introduced to the supply inlet to the lid to activate the nozzles and spray the bowl.

Suitably, in all embodiments, the lid is tightly sealed against leakage when closed, and the inside contour of the bowl is shaped so that the streams of spray, or jets from the nozzles, cover virtually the entire surface of the bowl. The lid and cover are hinged 90° apart on different sides of the bowl so that when the lid is closed for effecting a cleaning cycle the seat can be raised and, conversely, when the seat is lowered upon the bowl the lid can be raised.

These and other features and advantages will be better understood by reference to the following detailed description and to the accompanying drawings to which reference is made in the description. In the drawings, similar numbers are used to represent similar parts or components in the different figures.

Referring to the drawings.

Figure 1:
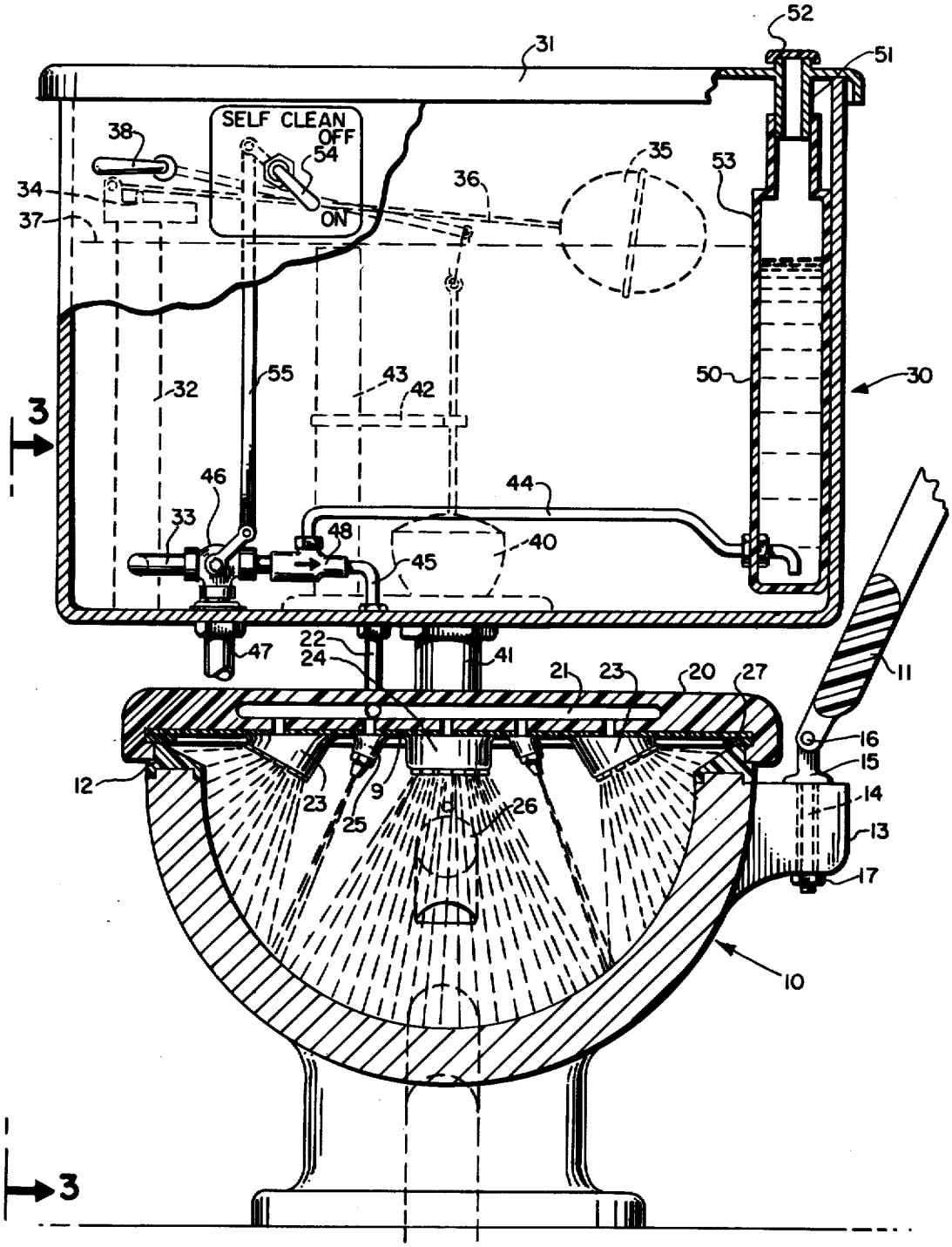
FIG. 1 depicts a front elevation view, principally in section, of a preferred type of self-cleaning toilet, inclusive of a toilet bowl with seat and lid, and an elevated reservoir tank which supplies water received from a source, and chemicals, to the bowl.
Figure 2:
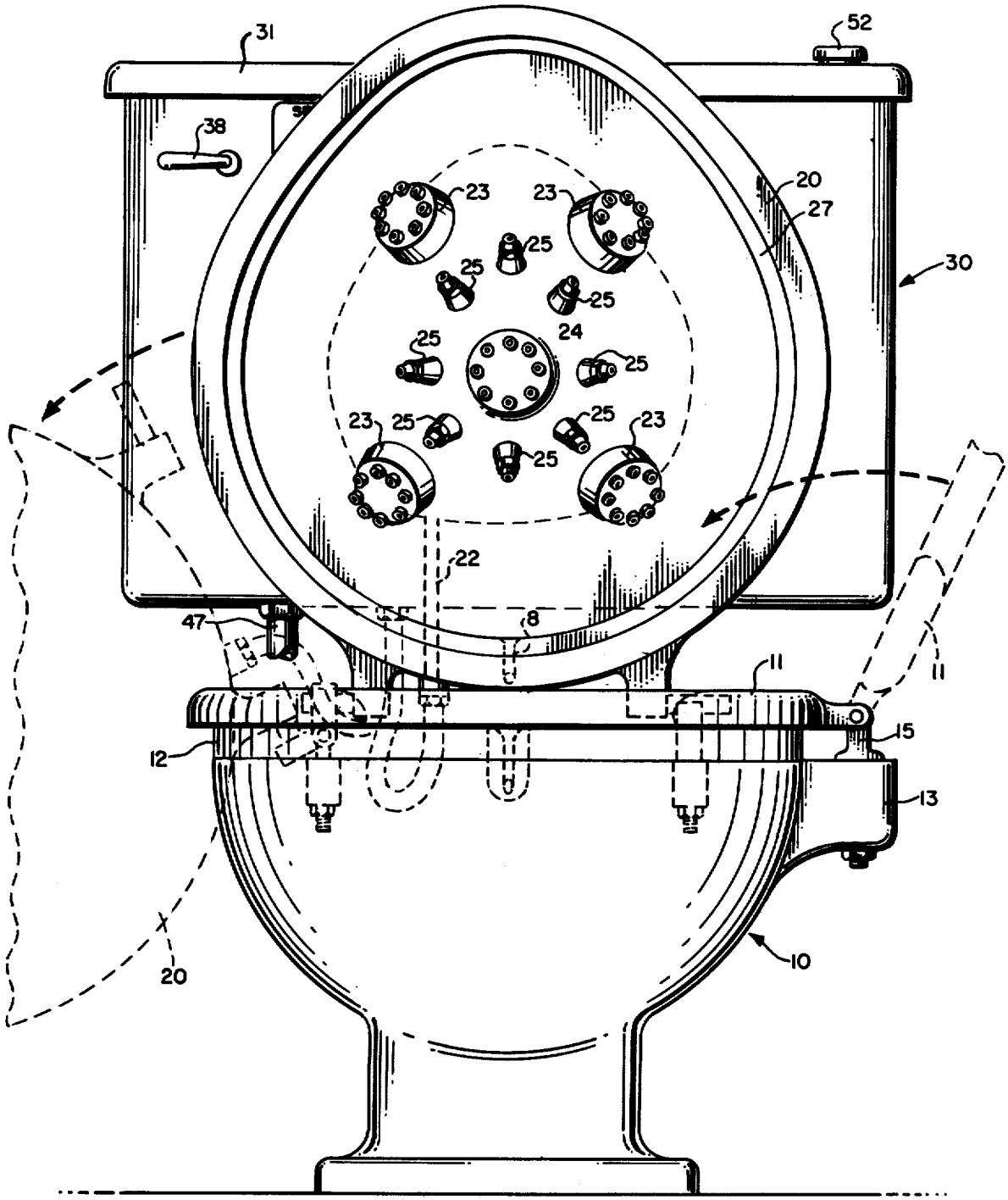
FIG. 2 depicts a perspective front elevation view of the toilet described in the preceding figure, this figure showing in raised position the cover, or lid, which is provided with an array of nozzles particularly designed, and located, to introduce jet sprays of a solution of biodegradable, chemical substances into the bowl.
Figure 3:
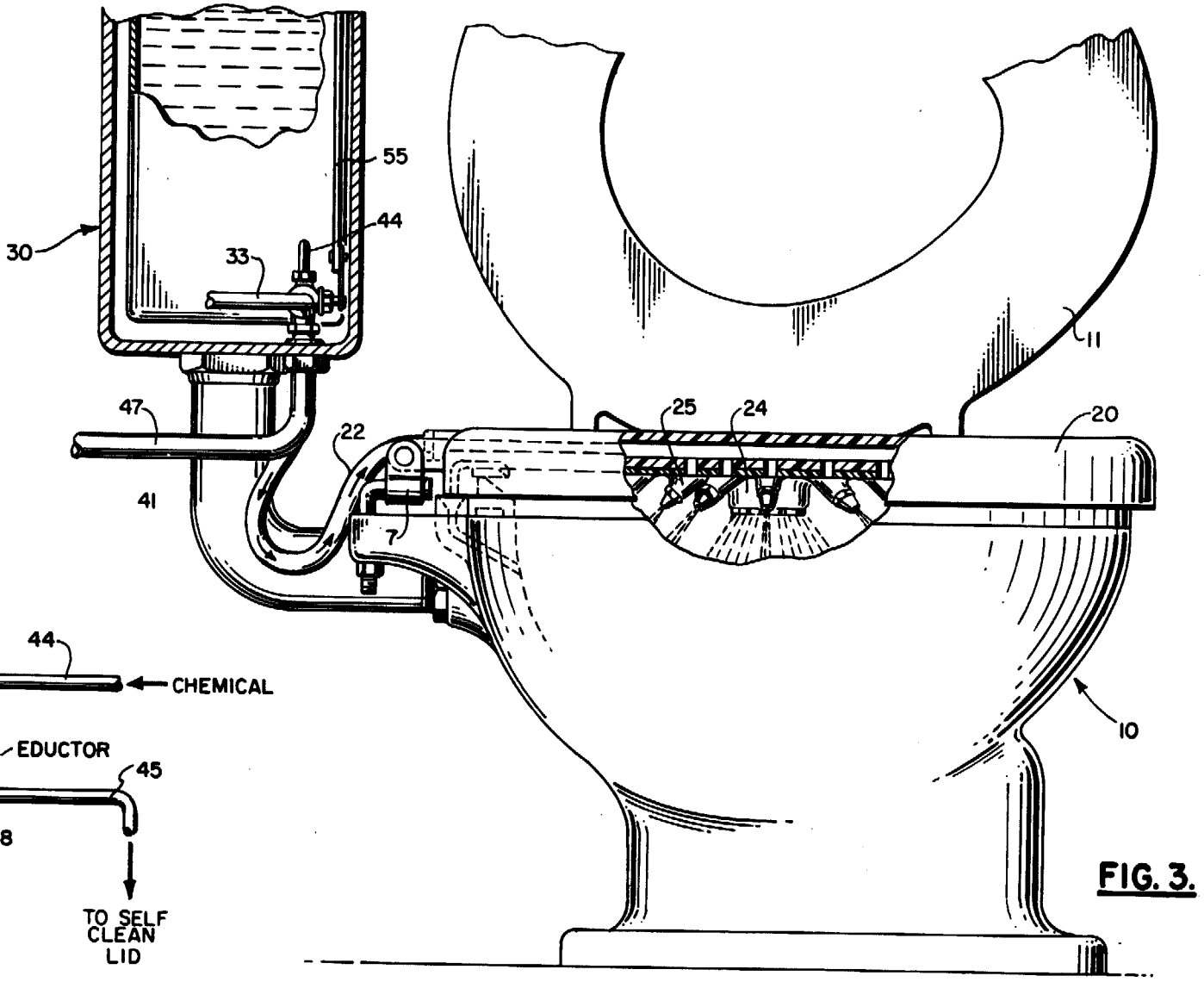
FIG. 3 is a side elevation fragmentary view, in partial section, of the self-cleaning toilet depicted in FIGS. 1 and 2.

Referring to the figures, initially to FIGS. 1 through 3, there is generally shown a preferred self-cleaning toilet, which includes overall a toilet bowl 10 provided with a seat 11 and lid 20, and an elevated reservoir tank 30. The seat 11 of the toilet bowl 10 is of generally conventional shape and design except that it is hinged at a location on the side of the bowl 10 rather than to the rear. The lid 20 is hinged at the rear to the bowl 10 and, unlike conventional toilet bowl covers, is provided with an array of nozzles which, when the lid 20 is closed to cover the top of the bowl 10, direct sprays or jets of liquid received from the elevated reservoir tank 30 and a supply source into the bowl 10. The elevated reservoir tank 30 includes conventional components for receiving water from a source and dispensing same to the bowl, but additionally includes a compartment from which biodegradable chemicals can be dispensed and admixed with the water supplied to the bowl 10 for effecting the self-cleaning action.

Referring now to FIG. 1, the bowl 10 per se is comprised of an open top vessel, supported upon a base normally attached to a surface, or floor, via bolts (not shown). A feature of the bowl 10 is that the inside thereof is contoured to eliminate crevices, or corners, so that all areas thereof are subject to direct contact by streams, or jets, or liquid sprayed thereupon from above by the nozzles located within the lid 20. The entire upper edge, or rim, of the bowl 10 is provided with a seal 12, constituted of a gasket affixed or secured thereto, and it is also contoured and shaped to permit direct contact with liquid spray from the nozzles, and to mesh with and provide an effective seal between the lid 20 and the top of the bowl 10. Suitably, the cross-section of the seal 12 (FIG. 1) is sloped inwardly and downwardly from an upper, outward point of contact with the inside face of lid 20 for maximum exposure to the liquid spray, and the outer side thereof is provided with an outer groove or indentation which meshes with a lower projection or circumferential lip located on lid 20. Preferably, the bowl seal 12 is constituted of a non-absorbent, resilient material, particularly a self-lubricated type of plastic. The polyhalogenated ethylenes, notably polytetrafluoroethylene (e.g., Teflon), are particularly preferred for this usage. Such material can be conveniently adjoined to the upper surface of the bowl 10 by use of various adhesives, which are particularly effective when the seal is effected via a tongue-and-groove effect as illustrated in the drawing (FIG. 1). The seat 11 is secured to a projecting surface 13 on a side of bowl 10 via pivotable attachment via cross bar 16 to a fixed yoke assembly 15, suitably comprised of a cross bar 16 located across a pair of parallel mounted threaded bolts 14 projected through a pair of parallel openings in the projection surface 13, and secured thereon by nuts 17 which are threadably engaged to said bolts 14. The seat 11, because it is mounted on a side of the bowl 10, can be lowered for use when the lid 20 is raised, or raised out of the way when the lid 20 is lowered. The lid 20, on the other hand, is hinged to the bowl 10 via a swivel connection 7 (FIG. 3) which not only permits lowering and raising the lid, but also a 180° rotation of the lid so that it can be used as a back rest free from interference from the projecting nozzles.

The cover, or lid 20, is hollow and contains conduits which can be supplied with liquid through a supply conduit, the outlet portion thereof being comprised of nozzle outlets. Referring to FIGS. 1 and 2 there is shown a cover, or lid 20, which contains a plurality of conduits, or header 21, to which water can be supplied by a suitable flexible conduit 22, the water being emitted into the interior of the bowl 10 via a jet spray system comprised of a plurality of nozzles of two types arrayed in different patterns, to wit: (1) a first series of four spaced apart nozzles 23 arranged in a generally elliptical pattern, and including a centrally located nozzle 24, each of which contains a plurality of spray openings which apply a spray of water, or solution, to the several quadrants, or sectors, of the bowl 10, and the center of the bowl, the sum-total area comprising essentially the whole of the bowl 10 from top to bottom, the liquid from nozzles 23 also impinging upon seal 12; and (2) a second series of nozzles 25 which are likewise arrayed in elliptical pattern and apply a quite intense jet of water around the section of the bowl 10, or line wherein the water level normally stands.

The lid 20, in application of the spray, is tightly closed (FIGS. 1 and 3), the seal 12 on the upper side of the bowl 10 being pressed tightly against a circular seal 27 located on the lower side of, and running entirely around the circumference of said lid. This seal 27 can be conveniently retained in place via use of an adhesive, and partially by seating a side thereof within the lip, or projection, located around the circumference of the lower side of lid 20. Contact between seals 27,12 also provides a bumper, or cushioning, effect which protects the lid and bowl when the lid 20 is closed. The entire lower face of the lid 20 preferably is coated with a water repellant plastic 9, e.g., Teflon, so that water which impinges thereon will be readily shed, and passed via drain tube 8 to the bowl 10.

The elevated water tank 30, which includes bottom and side walls as well as a removable cover 31, contains the usual vertical or upright riser tube which is connected to a water supply line 33, and a float operated valve 34 at the top of the riser tube 32. Valve 34 is operated, i.e., opened and closed, by action of the float 35 connected thereto via shaft 36. The valve 34 is opened to introduce water via conduit 33 when the liquid level 37 falls to a sufficiently low level and, conversely, closed to shut off the supply of water via conduit 33 when the water level within the tank 30 is sufficiently high. To flush the toilet, the tank 30 is caused to deliver water to the bowl 10 by operation of handle 38, which on rotation actuates linkage elements 39 and lifts the float 40 from its seat at the entry side of the large conduit 41, water being discharged from the tank 30 via conduit 41 and entering bowl 10 via the opening 26 located therein. As the water level in the tank 30 recedes, the float 35 falls to open the valve 34 and permit the introduction of water into the tank 30 via conduit 33. By virtue of the guide member 42, affixed to the riser 43, when the water drops to a sufficiently low level within the tank 30, the float 40 is caused to drop back into its seat within conduit 41 to permit the tank 30 to be refilled. After the tank 30 is refilled, the valve 34 is closed by action of the rising float 35.

The elevated water tank 30 is also provided with a chemicals-container 50, or vessel within which biodegradable chemicals are stored for admixture with water, and discharge to the bowl 10 to effect its cleaning. The chemicals-container 50 is preferably refillable after discharge of its contents, and hence it is provided with a refill tube 51 which extends through an opening within the cover 31 of tank 30, and a replaceable cap 52 which can be removed for filling of said container 50 with chemicals. An air vent 53, or vents, is provided to permit equilibration of pressure between tank 30 and the chemicals-container 50. Contents from the chemicals-container 50 are discharged via lines 44,45 and flexible conduit 22 to the jet spray system located in lid 20 to effect the cleaning of the bowl 10, and such cleaning action is triggered via manipulation of self-clean handle 54 after the bowl 10 has been flushed.

Figure 4:
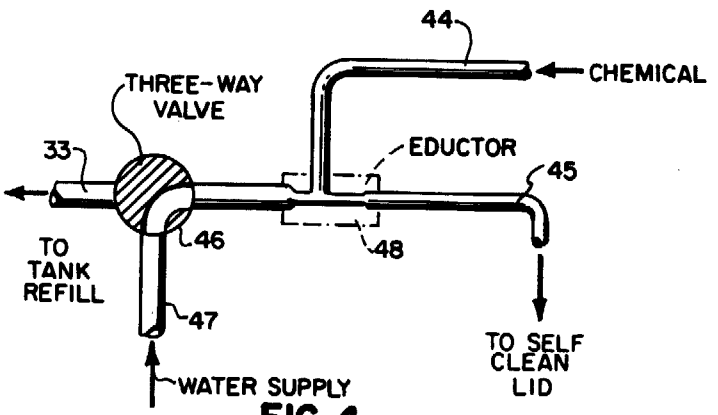
FIG. 4 depicts in schematic fashion the valved piping by virtue of which the water and chemical substances are introduced into the elevated tank and bowl of the toilet.

The self-clean handle 54, shown in on position in FIG. 1, is connected via a bell crank mechanism 55 to a three-way valve 46. In the position shown, referring also to FIG. 4, water enters through line 47 and passes via line 45 through the flexible conduit 22 and header 21, and is sprayed from nozzles 23,24,25. At the eductor 48, chemicals are drawn from container 50 via line 44 which enter into the bottom thereof, admixed with the water entering line 45 via venturi action, and passed to the jet sprays 23,24,25. This action is continued over the desired period, after which time the handle 54 is turned to an off position. The chemicals are permitted to remain in the bowl to continue their cleaning action. After use, the toilet can be flushed by manipulation of handle 38.

It is apparent that various modifications and changes, such as in the absolute and relative dimension of the parts, materials of construction and the like can be made without departing the spirit and scope of the invention as will be appreciated by those skilled in the art.

The toilets of this invention can be manually operated, or automated and operated via a timed sequence.

The conduits, and most portions of the toilet, are constructed of conventional materials, e.g., ferrous metals, iron, iron alloys, steel, and the like. The bowl and water tank per se are preferably constructed of earthernware, porcelain, and the like. The nozzles can vary in number and design, and can be fixed or movable upon the lid.

Having described the invention, what is claimed is:

1. A self-cleaning toilet embodying the combination of an open top toilet bowl and elevated reservoir tank mounted above said bowl, the reservoir tank including a water supply inlet for supplying water to said reservoir tank for discharge to said toilet bowl, and a separate compartment within which a biodegradable chemical or biological substance can be stored, removed therefrom and admixed with water, and the liquid formed thereby supplied to the toilet bowl to clean, disinfect and deodorize said toilet bowl, which comprises:

a seat and lid pivotally attached to said open top toilet bowl, the seat being pivotally attached to a side of said bowl from a juncture of attachment disposed at substantially right angles to the juncture of attachment of said lid so that the seat can be lowered atop the bowl, or raised while the lid is lowered, a circumferential seal on said bowl which seals the lid upon the bowl on closure, internal conduits and nozzle outlets, the nozzle outlets being located on the underside of said lid and communicated via said internal conduits with said water supply inlet, an outlet from the compartment within the reservoir tank through which said biodegradable chemical or biological substances can be passed, a float actuated valve located within the reservoir tank which is connected to said water supply inlet for introducing and regulating the flow of water from said water supply inlet to said tank, the flow of water being shut off when the float which actuates said float actuated valve is high due to a high water level, the flow of water to the bowl, being initiated when the float is low due to a low water level in the reservoir tank, a discharge conduit located in the bottom of said reservoir tank through which water can be discharged from said tank to the toilet bowl, a float seated within the discharge conduit of said reservoir tank through which water can be discharged from the reservoir tank for flushing the toilet, and the water level in the tank restored by the reseating of said float which permits the bowl to refill by the introduction of water through said water supply inlet to the reservoir tank which begins with the opening of said float actuated valve as the float operatively associated therewith falls with the water level, and ends with the closing of said float actuated valve as the float operatively associated therewith rises with the water level to cut off the flow of water to the tank, an eductor communicated via a first conduit with the outlet of the compartment within said reservoir tank through which said stored biodegradable chemical or biological substances can be passed, a second conduit communicating said water supply inlet with said eductor, and a third conduit extending from said eductor through said internal conduits of the lid to the nozzle outlets located within the lid of said toilet bowl, whereby water from said water supply inlet can be delivered through said eductor, and admixed with biodegradable chemicals or biological substances due to the action of the eductor, and the liquid then discharged via the nozzles of the lid, when the lid is closed, as a spray into the toilet bowl to clean, disinfect, and deodorize said bowl.

2. The apparatus of claim 1 wherein the interior of said toilet bowl is contoured so that the whole area comprising said bowl surface interior is directly contacted by liquid spray from the nozzles located above within said lid.

3. The apparatus of claim 1 wherein the seal which effects the sealing of the lid upon the toilet bowl is comprised of a self-lubricating plastic affixed upon and completely circumscribing the top of the bowl, and the inside surface thereof is inclined inwardly to provide a smooth, regular contour with the bowl so that the seal can be contacted by spray from the nozzles of the lid.

4. The apparatus of claim 3 wherein the seal is constituted of polytetrafluoroethylene.

5. The apparatus of claim 3 wherein the under-surface of the lid is also provided with an affixed circumferential seal which mates with the seal affixed upon the bowl, and the lower face of the lid is coated with a water repellant material.

6. The apparatus of claim 5 wherein the seal affixed upon the lid is constituted of polytetrafluoroethylene,

7. The apparatus of claim 1 wherein the nozzle outlets located on the underside of the lid are arrayed in patterns which include a first set of nozzle outlets, the primary function of which is to cover and apply the liquid which contains the chemical or biological substance to essentially the whole interior surface of the bowl, and a second set of nozzles, the primary function of which is to apply a similar spray to the water line where water normally stands in the bowl.

8. The apparatus of claim 7 wherein the first set of nozzles is arrayed in a substantially elliptical pattern with at least one nozzle at the center of said elliptical array and the second set of nozzles is arrayed in a substantially elliptical pattern to apply jets of liquid at the water line.

9. The apparatus of claim 1 wherein the elevated reservoir tank is provided with enclosing side and bottom walls, and a removable cover which is provided with an opening, the compartment located in the elevated reservoir tank which contains the biodegradable chemical or biological substance is vented, provided with a refill tube which is extendable through the opening in said removable cover, and a cap for uncovering said refill tube to add chemicals or biological substances, and for covering and enclosing said refill tube.

10. The apparatus of claim 1 wherein the eductor is comprised of a venturi section.

* * * * *